United States Patent [19]

MacKinnon

[11] Patent Number: 4,900,193

[45] Date of Patent: Feb. 13, 1990

[54] CONCRETE STRUCTURAL MEMBER SPLICING DEVICE

[75] Inventor: Alan G. MacKinnon, New Philadelphia, Ohio

[73] Assignee: The Foundation Equipment Corporation, Dover, Ohio

[21] Appl. No.: 311,968

[22] Filed: Feb. 16, 1989

[51] Int. Cl.[4] ..... E02D 5/10

[52] U.S. Cl. ..... 405/252; 403/294; 403/314; 403/369; 52/223 L; 405/256

[58] Field of Search ..... 405/250, 251, 252; 403/294, 287, 305, 314, 369; 30/294; 52/223 R, 223 L; 238/84, 85, 94

[56] References Cited

U.S. PATENT DOCUMENTS

| | | | |
|---|---|---|---|
| 3,104,532 | 9/1963 | Severinsson | 405/252 |
| 3,356,398 | 12/1967 | Nilsson et al. | 403/331 |
| 3,422,630 | 1/1969 | Marier | 405/252 |
| 3,545,214 | 12/1970 | Grazel | 405/252 |
| 3,650,553 | 3/1972 | Wennstrom | 403/282 |
| 3,901,042 | 8/1975 | Wahman | 405/252 |
| 3,930,373 | 1/1976 | Wahman | 405/252 |
| 4,009,550 | 3/1977 | Young | 52/726 |
| 4,314,777 | 2/1982 | Henderson | 405/251 |
| 4,604,003 | 8/1986 | Francoeur et al. | 405/252 X |
| 4,673,309 | 6/1987 | Schlaich et al. | 403/275 X |

OTHER PUBLICATIONS

"Splicing Concrete Piles", (Dyn.a.splice) San Jose, Calif.

"Hardrive" (Splice for Precast Concrete Piles) Franklin Lakes, N.J.

"Get it together with Sure-Lock Pile-Splice" (DFP Dougherty Foundation Productions, Inc.) Franklin Lakes, N.J.

*Primary Examiner*—Randolph A. Reese

*Assistant Examiner*—Arlen L. Olsen

*Attorney, Agent, or Firm*—D. Peter Hochberg; Mark Kusner; Louis J. Weisz

[57] ABSTRACT

A splicing device for concrete structural members includes two mating connectors positioned in axial alignment adjacent to each other that are interlocked by a key inserted through a keyway provided in the sidewalls of the connectors. Prestressing strands in the structural members to be spliced are fastened to the connectors by inserting them into axial holes located in the ends opposite the mating ends of the connectors, and thereafter wedging the strands within frustum-shaped cavities forming part of the holes, by means of frustum-shaped segments, or feathers, forced against the elements within the cavities. Apparatus and a method for installing the splicing device is also described.

16 Claims, 10 Drawing Sheets

CONCRETE STRUCTURAL MEMBER SPLICING DEVICE

TECHNICAL FIELD

This invention relates to a device and methods for connecting structural members. More particularly, this invention relates to a device for splicing prestressed-concrete members in a way that transfers stresses imposed thereon in an axial manner and to a method for installing the device. Specifically, this invention relates to the coupling of prestressed reinforcing elements located within adjacent concrete structural members by means of keys which interconnect coupler components attached to the ends of the elements in the members.

BACKGROUND OF THE INVENTION

Concrete structural members have long been recognized as providing significant advantages over structural alternatives such as steel beams, or equivalent structures. As a consequence, such members are widely used as skeletal components for precast buildings, foundation pilings, and in numerous other applications. While well adapted for such uses, particularly due to their exceptional ability to resist compression loading without damage, concrete structural members are unfortunately unable to withstand substantial tensile stressing. To a significant degree, however, this inability can be compensated for through the use of reinforcing elements such as steel reinforcing bars and strands, positioned within the concrete members, particularly through the use of longitudinal reinforcing elements that are maintained under tension until the concrete around them has set. Concrete structural members thus formed, termed "prestressed"-concrete members, are thereafter better able to resist tensile forces to which they are exposed. Such enhanced ability is particularly desirable, for example, in connection with the erection of buildings employing concrete girders and columns, since during the course of construction, or in service, the latter can be subjected to longitudinal tensile stressing, or to lateral forces which simultaneously produce tensile forces on one side of the members, and compressive forces on the other.

Similarly, in the case of concrete piling, widely used to support heavy structures including buildings, bridges, and the like, the handling, as well as the driving of the piles unavoidably involves their exposure to tensile loadings produced by lateral and other forces acting on them which the prestressing helps to resist. To reduce this exposure during handling, the piles are frequently fabricated in relatively short lengths, a strategy which not only allows lighter loads to be transported from the casting yard to the job site, but reduces the lateral loadings resulting from the heavy weight of the piles during their handling preparatory to being driven. After their arrival at the point of use, the short piles are spliced together during the installation process to form piling of the desired length.

While such expedients have greatly helped to minimize damage to concrete structural members, they are still relatively vulnerable to tensile stressing, particularly at their points of joinder with each other, as when the members are fastened together in the case of the segmented pilings described, or in multi-storied buildings in which vertical concrete columns are placed on top of each other to form the structure, and in which horizontal girders are interconnected.

In the past, a variety of methods have been proposed to accomplish such joinder or splicing, for example, plates designed to fit over the ends of the concrete members, in combination with bolts having a hollow capped collar on the end opposite their head end which allows them to be screwed onto exposed, threaded ends of reinforcing bars whose other end is anchored in the concrete members. Adjacent bars can then be connected with a "wedge" that couples the heads of bolts on adjacent bars, fastening the piles together. However, the devices are frequently unable to maintain the spliced joint under tension, such inability resulting in "play" between the connected members which results in their misalignment. Such misalignment can lead to the development of lateral forces which produce undesirable tensioning along the members. Furthermore, while the plates of the device described include a pin means to aid in centering the members over each other, the alignment thus achieved is of a "single-point" type, and the wedges can be difficult to insert at their point of installation, due to imperfect alignment.

A somewhat similar splicing device involves the use of metal end plates fixed to the end of concrete members by anchor bars fastened on one end to the plates, the other end of the bars being buried in the ends of the concrete members. Such plates also have prestressing elements attached thereto, and keyways are provided around the periphery of each of the plates into which keys are driven after abutting plates are aligned, locking the plates together. The device described is deficient, however, in that it is unable to transfer tensile forces acting between the concrete members directly across axially aligned prestressing elements. In addition, and as in the case of the prior-described device, there is no method for maintaining constant tensioning between the plates at the interface of adjacent structural members, exposing the concrete members to the possibility of stress forces generated by the misalignment resulting from play between the plates. Furthermore, and again, the keyways in the plates can be difficult to align preparatory to inserting keys therein.

A number of splicing devices have been patented, including that shown in U.S. Pat. No. 3,104,532, which provides pile sections fitted with gripping head plates, and complementary gripping sleeve plates, the plates being interlocked by twisting them relative to each other after contact.

U.S. Pat. No. 3,356,398 teaches interlocking joint members designed for placement at the ends of pile members.

U.S. Pat. No. 3,422,360 contemplates the use of male and female metal caps that fit the ends of concrete piles to be drawn together. Connection is accomplished by the insertion of locking rods introduced through access passages located in one of the caps, into a recessed groove in the mating cap.

U.S. Pat. No. 3,545,214, for example, discloses building pile sections whose ends are furnished with plates that provide a male/female relationship relative to each other, allowing alignment of adjacent piles to be maintained.

U.S. Pat. No. 3,650,553 discloses plate-shaped members adapted for connection with the ends of the pile sections to be joined together. Locking wedges are provided for fastening the plate members to each other.

U.S. Pat. No. 4,009,550, shows shaped end plates secured to the ends of piles that can be locked together with locking pins. The plates are configured to have reinforcing bars attached thereto.

U.S. Pat. No. 4,314,777 illustrates piles whose ends are respectively fitted with male and female sleeves that are connected by means of a pin passed through the two sleeves following their mating, thus locking them together.

While all of the preceding accomplish splicing of the piles with which they are associated, they suffer from the lack of direct axial connection between prestressing members, as well as from a number of other deficiencies such as difficulties in achieving proper alignment, involved handling procedures, and various other problems.

DISCLOSURE OF THE INVENTION

In view of the preceding, therefore, it is a first aspect of this invention to provide an improved device for splicing concrete structural members together.

A second aspect of this invention is to provide a device for splicing concrete structural members that allows stresses in the prestressing elements in adjacent piles to be axially transferred between the members directly across the splice.

Another aspect of this invention is to furnish a splicing device for concrete structural members that permits the prestressed reinforcing elements within adjacent members to be readily aligned.

An additional aspect of this invention is to make available a splicing device for prestressed-concrete structural members that can be fabricated so that it is relatively lightweight, compared to prior art devices.

A further aspect of this invention is to provide a splicing device for prestressed-concrete structural members that allows the members' prestressing elements to be easily aligned and co-axially locked together by connecting keys.

Yet an additional aspect of this invention is to provide prestressed-concrete structural members that are designed to maintain continuing tension at the place of interconnection between the prestressing elements and the splicing device.

Yet an additional aspect of this invention is to provide a splicing device that may be easily and quickly connected to prestressing elements employed in connection therewith.

Still another aspect of the invention is the provision of a special tool for trimming away surplus amounts of the prestressing elements fastened to the splicing device.

A still further aspect of this invention is to provide casting bed apparatus, and a method for its use that permits multiple prestressed concrete members to be simultaneously formed with splicing devices of the invention.

Another aspect of the invention is to provide a method by which prestressed concrete members can be fabricated so that the splicing devices of the invention located in adjacent members can be perfectly aligned, thereby facilitating the insertion of connecting keys into the keyways located in the devices.

The foregoing and other aspects of the invention are provided by a concrete structural member splicing device comprising:

two elongated blocks;

holding means; and locking means, wherein each of said blocks has an axial hole passing through the longitudinal axis thereof, said blocks adjoining each other at one end and being immovably so adjoined by said holding means, and said locking means being adapted to grip concrete structural member prestressing elements extending into the unadjoined ends of each of said block members so as to transmit tensile forces acting on said elements axially through said blocks.

The foregoing and additional aspects of the invention are provided by a concrete structural member having longitudinal prestressing elements located therein, one end of each of said elements being connected to a male connector as defined in the preceding paragraph that is positioned on one end of said member, and the other end of each of said elements being connected to a female connector as defined in the preceding paragraph that is positioned on the other end of said member.

The foregoing and still other aspects of the invention are provided by a tool for trimming prestressing elements used in connection with the splicing device of the preceding paragraphs including:

a body portion;

an extraction lug; and a cutting edge, said body portion comprising an elongate member having said cutting edge located on one end thereof, and said extraction lug extending at substantially right angles from said body portion, said body portion having a transverse-cross section adapted to pass through the keyways provided in said device, and said cutting edge being positioned on said end so as to contact said prestressing elements at the level of the bottom of said keyways when said body portion is driven through the keyways.

The foregoing and additional aspects of the invention are provided by a master template for fabricating prestressed concrete structural members in a casting bed comprising:

a plate member, and a plurality of plate insert plugs, wherein said plate member contains a plurality of first strand holes therein adopted to receive prestressing strands passing therethrough, and also contains the same said plurality of countersunk aread on one side thereof, coaxial with said strand holes and capable of receiving said insert plugs therein, said plate member also having first alignment holes extending therethrough, said first alignment holes being adopted to receive alignment bushings therein, said first alignment holes being positioned over said countersunk areas, and wherein said insert plugs are dimensioned to be received into said countersunk areas, and when so received, second alignment holes in said insert plugs are positioned opposite and coaxial with said first alignment holes, said second alignment holes also being adopted to receive said bushings, and said plugs also being provided with second strand holes passing therethrough coaxial with said first strand holes, and wherein further, following their insertion into said plate member, the exposed surface of said insert plugs being adopted to mate with a said shaped end of a connector of the splicing device of the invention and wherein still further, when so mated, said bushing holes are positioned so that inserted bushings are located within said keyway extending through said connector, so that said plate member, insert plug, and connector can be fastened together with bolts passing through said bushings into tapped holes located coaxially with said bushings in the bottom of said keyway.

The foregoing and still additional aspects of the invention are provided by a collapsible bulkhead for connecting master templates employed in fabricating prestressed concrete structural members comprising:

hollow sleeve members;

sliding members;

supporting perforate flange members; and pins, wherein a plurality of said sleeve members are positioned in a plurality of said supporting flange members, at right angles thereto to form a box-like structure through which prestressing strands can be passed, and wherein each of said sleeve members is provided with aligned holes in the walls thereof adopted to receive one of said pins, and wherein said sliding members are adopted to be received in said sleeve members and to telescope therein, said sliding members also being provided with a hole at right angles thereto, positioned therein, so that said pins can be simultaneously passed through the holes in said sleeve members and said sliding members, thereby maintaining the positional relationship of said members, and wherein further, when said pins are maintaining said positional relationship, said sliding members extend a predetermined amount from said sleeve members, and when said pins are removed, said sliding members are free to telescope within said sleeve members.

The foregoing and yet further aspects of the invention are provided by the process of simultaneously forming multiple prestressed concrete members in a casting bed, comprising:

fastening connectors for a structural member splicing device according to the invention to master templates according to the preceding paragraph;

fastening one of said master templates on each side of a collapsible bulkhead according to the preceding paragraph to form assemblies;

threading prestressing strands through said assemblies and through hollow tube members adjacent said connectors;

fastening one end of said strands to a stationary casting bed bulkhead, and the other end of said strands to a casting bed jack;

placing said strands under tension;

pouring and curing the concrete;

installing said feather members;

removing said pins;

releasing said tension; and thereafter severing said prestressing strands at a point within said collapsible bulkhead.

BRIEF DESCRIPTION OF THE DRAWINGS

The invention will be better understood when reference is had to the following FIGS., in which like-numbers refer to like-parts, and in which.

DETAILED DESCRIPTION OF THE INVENTION

Figure 1:
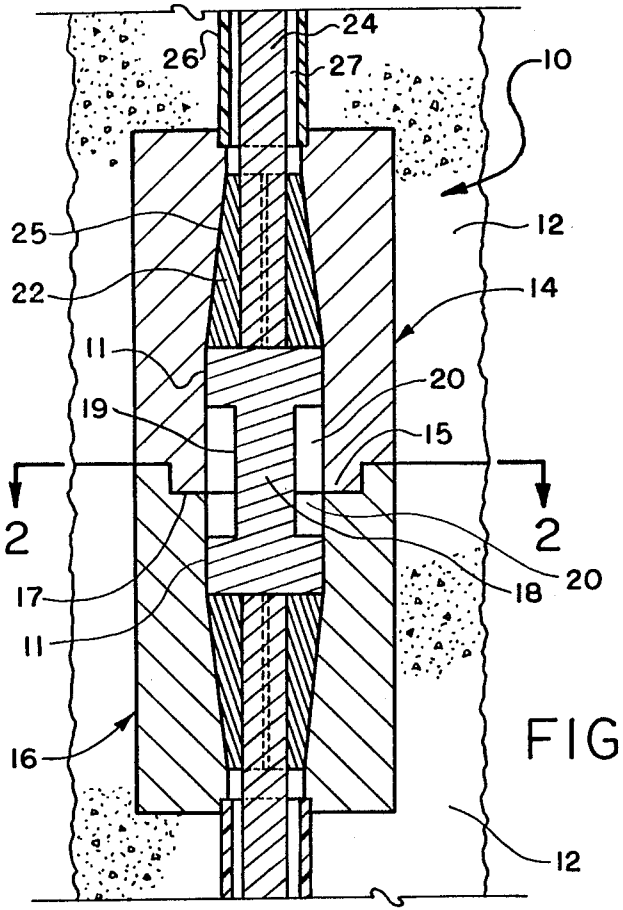
FIG. 1 is a vertical cross-section taken through the center of the splicing device of the invention.

FIG. 1 is a vertical cross-section taken through the center of the splicing device of the invention, generally 10. As illustrated, a male fitting 15 extending from a male coupling connector, generally 14, is disposed in the female cavity 17 of a female connector, generally 16. While cylindrical connectors or connector "blocks" are illustrated in the Figure, connectors having different transverse cross-sectional shapes might also be employed, for example, connectors with rectangular or other multi-lateral transverse cross-sections. A locking key 18 is disposed in a keyway in each of the members defined by the spacing 19 between opposed ledge members 20, and by the transverse cross-sectional shape of a cylindrical chamber 11, adjacent the ledge members. In the Figure, the male and female connectors are located in concrete structural members 12. Each of the connectors has a prestressing element 24 extending into the unjoined, free end of the connectors through a hollow tube 26 connected to each of the connectors forming a "relaxation cavity," 27, a space free of concrete. After passing through the relaxation cavity, the prestressing element 24 enters a frustum-shaped space 25 in which it is secured by frictional contact with a locking device in the form of multiple longitudinal prestressing element gripping segments 22, usually two in number, of a hollow conical frustrum member, termed "feathers." The relaxation chamber 27 functions as an energy reservoir chamber which enables tension to act continuously on feathers 22, due to the frictional forces between the feathers and the element 24. The application of the continuing tension on the feathers 22 causes them to be continually forced towards the smaller end of the frustum-shaped space 25, reinforcing the gripping action of the feathers against the element 24, effectively preventing the prestressing element from being withdrawn from the connectors, and effecting transmission of the tensile force in the elements to the connectors.

The tensile force thus generated on a connector is axially transmitted to its counterpart connector through the locking key 18. Such axial alignment of the tensile forces in the prestressing elements of each of the structural members 12 effectively maintains the position of the members, preventing their misalignment, and therefore, the destructive lateral forces produced by such misalignment. The relaxation cavity 27 assures continuous tensioning of the splice due to the elasticity of the portion of the prestressing element located within the relaxation cavity, tensioning that would not be possible if the prestressing element were to be completely encased in immobilizing concrete. The length of the relaxation chamber should at least be of the length, preferably somewhat in excess of the length required to develop the design prestress load for the strand design of the concrete structural member.

Furthermore, the transfer of tensile stresses co-axially through the splicing devices eliminates the possibility of force-multiplying moment arms which would otherwise aggravate stressing at the point of splicing.

Figure 2:
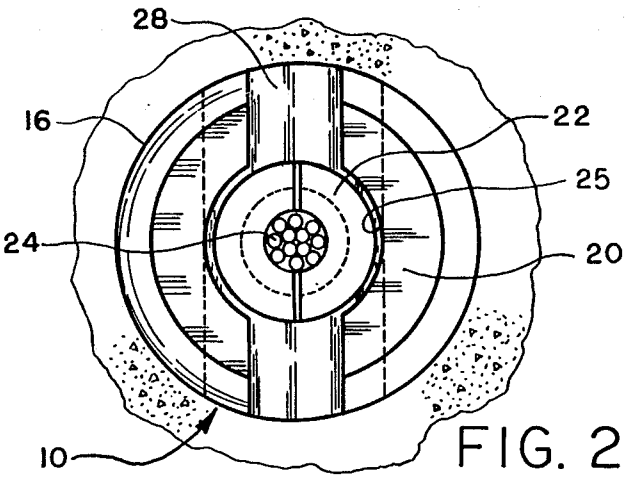
FIG. 2 is an end elevation of the female connector of FIG. 1 along line 2—2 of FIG. 1.

FIG. 2 is an end elevation of the female connector of FIG. 1 along line 2—2 of FIG. 1 showing further details of the action of the longitudinal segments, or feathers 22, in the hollow frustum space 25, and their frictional relationship with the prestressing element 24, the element being shown in the Figure as a multi-filament strand. Also shown are ledge members 20 and the bottom of keyway 28 which passes through opposite walls of the cylindrical chamber of the female connector 16.

Figure 2A:
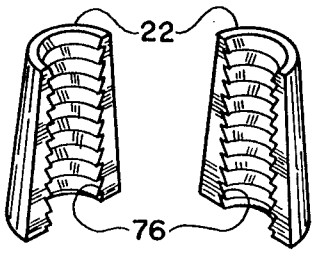
FIG. 2A is an isometric view of several of the feathers that secure prestressing elements to the connectors.

FIG. 2A is an isometric view of several of the feathers 22 which secure the prestressing elements to the connectors, showing a typical configuration. While two feather segments are typically employed in connection with the splicing device of the invention, more than that number could also be employed, it only being necessary that at least two feathers frictionally engage the prestressing element. As shown, the feathers 22 are provided with multiple transverse threads to enhance the gripping action of the feathers on the prestressing elements. While buttress threads are shown, other types, for example V-threads could also be employed.

Figure 3:
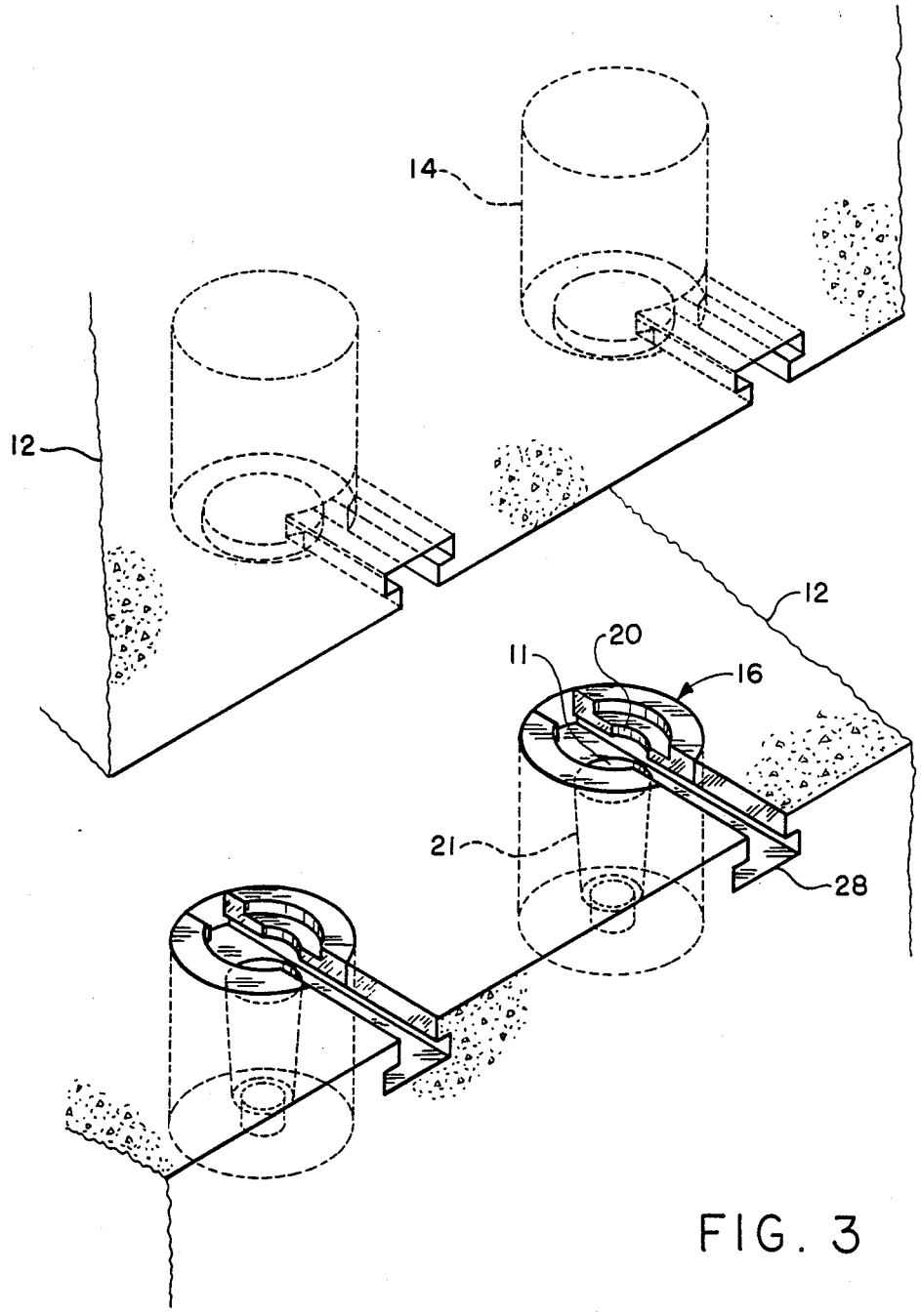
FIG. 3 is an isometric view of adjacent prestressed-concrete structural members provided with connectors of the invention.

FIG. 3 is an isometric view of adjacent prestressed structural members provided with connectors of the invention. As shown by the Figure, a lower structural member 12 contains a plurality of female connectors, generally 16, connected to prestressing elements, not shown. Keyways 28 allow locking keys, also not shown, to be driven into the interior of the connectors, where ledge members 20 function to allow the locking keys to fasten the lower structural member 12 to the upper member 12, in which latter the male connectors are disposed.

Figure 4:
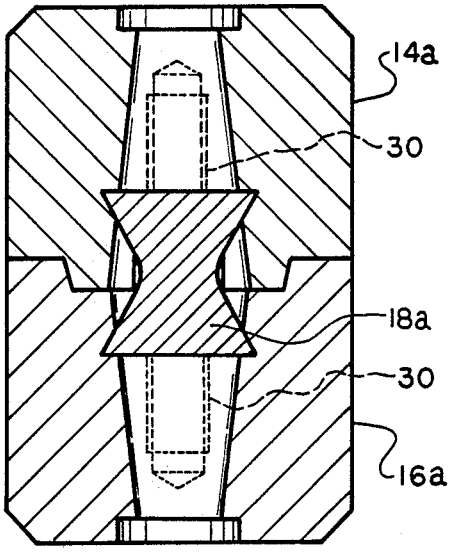
FIG. 4 is a vertical cross-section through the center of another embodiment of the splicing device of the invention.

FIG. 4 is a vertical cross-section through the center of another embodiment of the splicing device of the invention. While FIG. 1 shows a locking key having an "I-beam" shaped cross-section, FIG. 4 shows a locking key with an "hourglass" shaped cross-section. As in the case of the device of FIG. 1, the device of FIG. 4 interlocks a male connector 14*a*, with a female connector 16*a*. The Figure also shows alignment bolt holes 30, adapted to permit fastening of the connectors to a master pattern template, as will be explained in greater detail in the following.

While fabrication of prestressing structural members using master pattern templates is a preferred embodiment of the splicing devices of the invention for a variety of reasons, some of which having been mentioned, the connectors may also be permanently welded to an end plate that is thereafter retained by the structural member following tensioning similar to that previously described. If desired, such plates can also be provided with a lateral skirt extending from the plate adjacent to the sides of the structural members. In such cases, attachment of the tensioning abutments and bulkheads is made directly to the end plates, which, as stated, are retained by the finished structural members.

Different structural members may be prepared using the splicing device of the invention, including members having a round, square octagonal or other cross-sectional shape. In addition, while sufficient numbers of the connectors must be attached to the prestressing elements to achieve the moment capacity required, additional reinforcing elements may be included that are unattached to the connectors.

Figure 5:
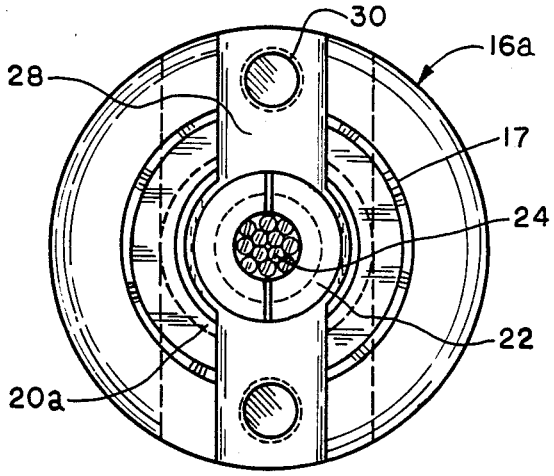
FIG. 5 is an end elevation of the female connector of FIG. 4.

FIG. 5 is an end elevation of the female connector of FIG. 4. The Figure shows the female connector, generally 16*a*, with a female cavity 17 disposed in the top thereof, and a prestressing element 24, held by feathers 22. Also positioned in the bottom of keyway 28 are bolt holes 30, whose use has been previously briefly described in connection with the temporary fastening of the connectors to a master pattern template. The ledge members 20*a* provide a bearing surface, which together with a suitable locking key, interconnect the male and female connectors.

The use of a plurality of connectors, as particularly illustrated in FIG. 3, greatly facilitates alignment of the concrete structural members since the multiple male/-female interfaces thus provided avoid the single point orientation referred to in connection with the prior art devices, assuring rapid and positive positioning of the structural members relative to each other, thereby permitting the locking keys to be easily inserted in the respective keyways. The keyways may be plugged with a suitable mastic after insertion of the locking keys.

Figure 6:
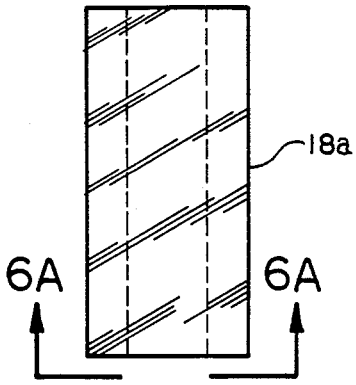
FIG. 6 is a side elevation of the locking key member of FIG. 4.

FIG. 6 is a side elevation of a locking key member 18*a* of FIG. 4. The locking key 18*a* has an hourglass shape, as is shown more particularly in FIG. 6A.

Figure 6A:
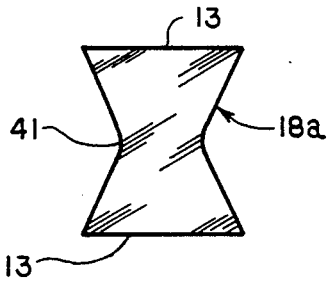
FIG. 6A is an end elevation of the locking key member of FIG. 6.

FIG. 6A is an end elevation of the locking key of FIG. 6, more clearly illustrating its cross-sectional shape. The Figure shows the transverse end portions 13 of the locking key 18*a*, connected by a center portion 41, the latter portion being narrower than the former portions, thereby providing the "locking" action when the key is inserted in the keyway. The hourglass configuration provides particular advantages since it can be fabricated by rolling or cold-drawing, obviating any need for expensive machining procedures.

Figure 6B:
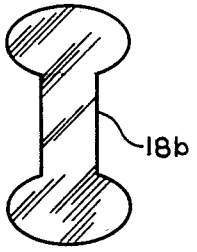
FIG. 6B is an end elevation of another embodiment of a locking key member.

FIG. 6B is an end elevation of still another embodiment of a key member 18*b*. The key shown exhibits the cross-sectional shape of a "dumbbell," again, the transverse end portions being larger than the center portion in order to provide a locking action. If desired, other locking keys having different cross-sectional shapes may also be used.

Figure 7:
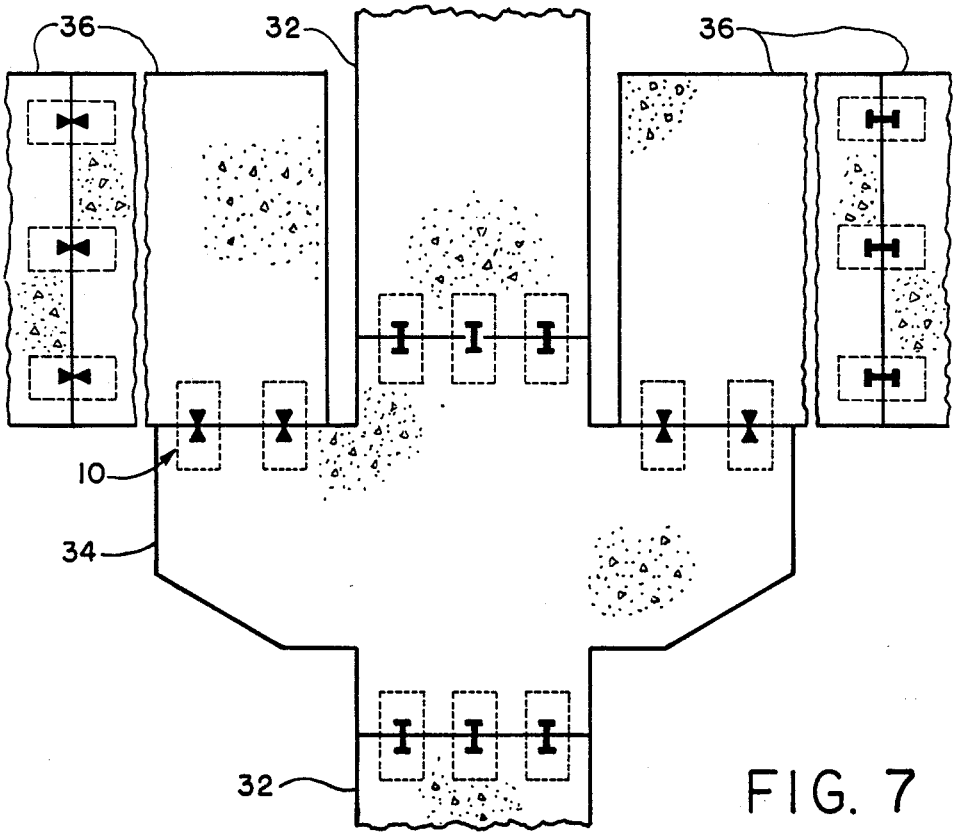
FIG. 7 is a partial side elevation of concrete structural members connected by the splicing device of the invention.

FIG. 7 is a partial side elevation of concrete structural members connected by the splicing devices of the invention. In the Figure, two columns 32 are positioned in alignment with each other, in association with an intervening "haunch" 34. Resting on the haunch and connected thereto by the splicing devices 10 are girders 36, which are interconnected with still other girders by the splicing devices. While the splicing devices of the invention are particularly adapted to the connection of concrete structural members with aligned prestressing elements, since a direct connection is thereby provided between the prestressing elements due to the axial interconnection of the elements through the splicing devices, the devices may also be used to provide an interlocking connection for structural members independent of the prestressing elements, as illustrated by the interconnection of the girders 36 with haunch 34.

In addition, while the splicing devices of the invention are primarily intended for, and particularly adapted for use in connecting multi-filament strands, a preferred use of the devices, they may also be employed to connect prestressed reinforcing bars with strands, or reinforcing bars to each other.

Figure 8:
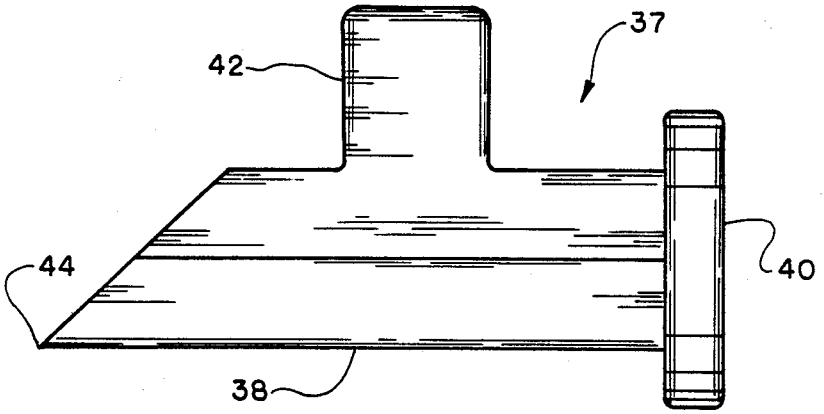
FIG. 8 is a side elevation of a tool used in cutting surplus portions of prestressing elements from the connectors used in connection with the splicing device of the invention.

FIG. 8 is a side elevation of a tool used in cutting surplus portions of prestressing elements from the connectors used in connection with the splicing devices of the invention. In FIG. 8, the cutting tool, generally 37, is shown comprising an elongate body portion 38 having a cutting edge 44 disposed on one end thereof. The other end 40 is used as a driving head designed for impaction by a suitable tool, for example, a hammer, to force the cutting edge against the prestressing element to be cut. A retraction lug 42, extending from the body portion, preferably at right angles thereto, provides a surface that may be struck to force the tool out of the keyway, following cutting of the prestressing element.

Although the surplus portion of the prestressing element located above the feathers in the connectors can be burned away, for instance with a cutting torch, the use of the cutting tool 37 is particularly useful, since when the strands are sheared off by the cutting edge of the tool, they are deflected away from the cutting edge. Thereafter, when the locking key is driven in, the deflected strands have a tendency to reassume their upright position, assisting in locking the keys in position. If desired, the keys may also be secured in place by peening the edges of the keyways over a portion of the entrance to the keyways, preventing the keys' withdrawal.

Figure 8A:
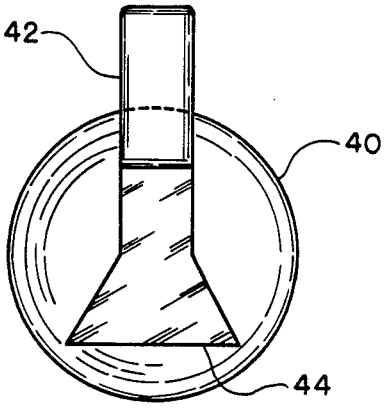
FIG. 8A is an end elevation showing the cutting end of the tool of FIG. 8.

FIG. 8A is an end elevation showing the cutting end of the tool of FIG. 8. As shown, the body portion of the cutting tool has a shape adapted for insertion in a keyway, for example that shown in FIG. 4, and is provided with a cutting edge 44 on the lower portion of the body. The driving head 40 is shown as having an enlarged circular shape; however if desired, the tool could simply be struck on the end opposite the cutting edge to force it against the prestressing element, obviating any necessity to provide the enlarged circular end portion illustrated. FIG. 8A also discloses more clearly the details of the retraction lug 42, showing the edge of the lug that is struck to force the tool out of the keyway after the cutting operation has been completed.

Figure 9:
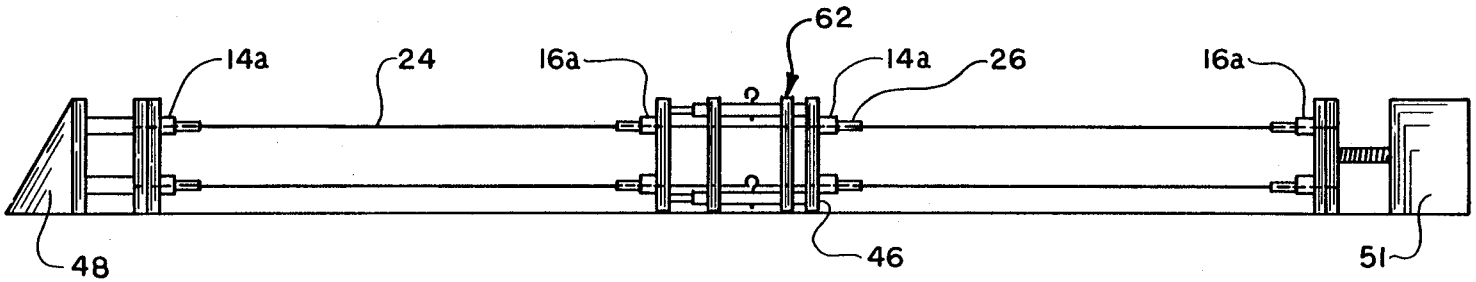
FIG. 9 is a semi-schematic view of the apparatus and splicing device of the invention arranged in a casting bed.

FIG. 9 is semi-schematic view of the apparatus and splicing device of the invention arranged in a casting bed. As shown, a male coupling connector **14*a* and a female coupling connector 16*a*, with strand tubes 26 associated therewith are connected to master templates 46, more particularly described in connection with FIG. 14, the connectors being connected by prestressing strands 24. Master templates thus prepared are attached to either side of the collapsible bulkhead assembly, generally 62. One of the other master templates is attached to an anchoring abutment 48, and one master template to a jacking abutment 51. The process of forming the prestressed concrete members comprises initially fastening male connectors to one of the master templates and female connectors to another. In a double casting bed where two concrete structural members are to be formed simultaneously, master templates 50 thus prepared are fastened to opposite ends of the collapsible bulkhead, described in more detail in connection with FIG. 16**, while one of such templates is attached to the jacking abutment, and another to the anchoring abutment. Prestressing strands are then threaded through the connectors, from the anchoring abutment to the jacking abutment, being threaded through strand tubes associated with the connectors in the process. The prestressing members are thereupon placed under tension by means of a jack, and the concrete is cast in the shape of the structural members desired. Curing of the concrete to its specified strength thereafter proceeds, sometimes assisted by steam, and the feather members are then inserted about the strands in the connectors. The hitch pins of the collapsible abutment are next removed, following which the bed tension is released, permitting the pins to telescope within the tubes of the collapsible abutment, and removing tension from the strands passing through the collapsible assembly. The strands within the collapsible abutment are thereupon severed and the attachment of the strands to the anchoring and jacking abutments is disconnected. The piles can then be removed from the casting bed, the master templates removed, and the surplus portion of the strand eliminated as previously described, or otherwise, completing the fabrication.

Modifications of the procedure described may also be employed, for example, more than two structural members may be fabricated in the casting bed by using multiple collapsible abutments, or a single member may be fabricated, in which case the collapsible abutment is not required.

Figure 10:
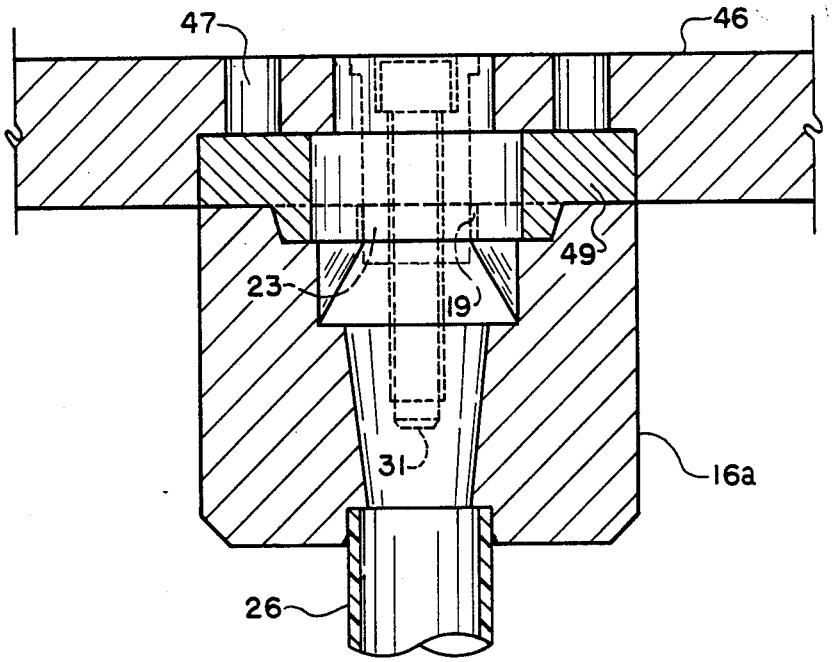
FIG. 10 is a vertical cross-section through the center of a female connector attached to a master template.
Figure 11:
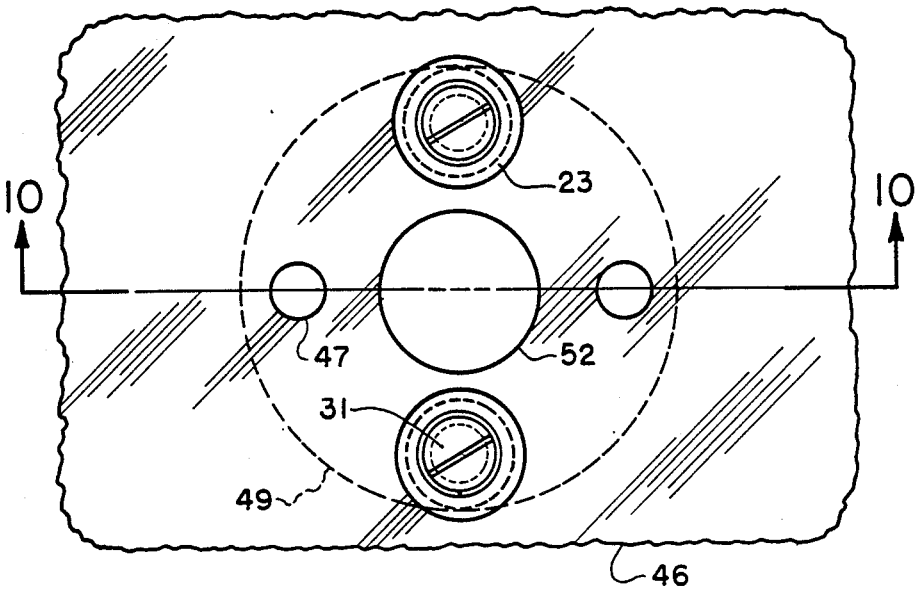
FIG. 11 is a top plan view of the master template of FIG. 10.

FIG. 10 shows a vertical cross-section along line 10—10 of FIG. 11 through the center of a female connector attached to a master template. As shown, a master template comprising a plate member 46, containing a male template plug 49 inserted in a countersunk area is provided with a female coupling connector **16*a* fitted over the plug. An alignment bushing 23 is thereafter inserted through the bushing, extending through the master template 46, and the template plug 49, into the keyway in the connector 16*a*. A bolt 31 is thereafter inserted through the bushing, extending into tapped holes in the bottom of the keyway. The attachment described between the master template and the connectors is important in assure that the keyways are accurately aligned so as to enable easy, subsequent insertion of the locking keys. The bushing 31 permits accurate location of the connectors in the template by virtue of the controlled clearance 19 between the bushing and the narrowest part of the keyway. While this clearance may vary in tolerances well known to the art, and while it will in part depend upon the tolerance of the bushing 23 within the master template, commonly the tolerance between the bushing and the keyway wall will be about 5 one thousandths of an inch, while the tolerance between the bushing and the master template will be about 10 one thousandths of an inch. The figure also shows knock out holes 47, which serve the purpose of assisting in the "knocking out" of the template plug 49, for example, done in the case where a prestressing strand is not required in a particular countersunk location, in which case the template plug is replaced by an unperforated blank plug. Also shown, is the strand tube 26**.

FIG. 11 is a top plan view of the master template of FIG. 10. The Figure shows the knock out holes 47, along with the bushings 23 and the bushing bolt 31. Strand hole 52 passes through the center of the template plug 49. Other than in the case of the bushings 23, whose size is related to the size of the connector keyways as previously described, the overall size of the template plug, the knock out holes, and the strand hole, are relatively unimportant. Typically, the diameter of the template plug 49 will be from about 3 to 3½ inches in diameter, while the strand hole 52 will be from about 1 to ½ inches in diameter. The knock out holes 47 commonly will be in the order of ¼ to ½ inch in diameter. The thickness of the plug may also vary, however, in connection with plugs having the dimensions described, the thickness will normally be about ⅜ inch.

Figure 12:
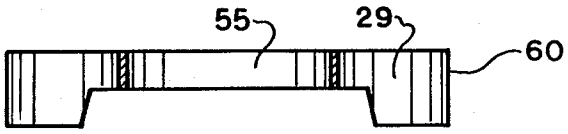
FIG. 12 is a side elevation of a female master template plug.

FIG. 12 is a side elevation of a female master template plug. The relationship of the plug to master template 46, is the same as that between the master template and the male template plug 49 previously described. As illustrated, the template plug 60 is provided with a strand hole 55 and a bushing hole 29. As mentioned, where neither a male nor a female template is required, a blank plug with no holes therein is inserted into the master template 46.

Figure 13:
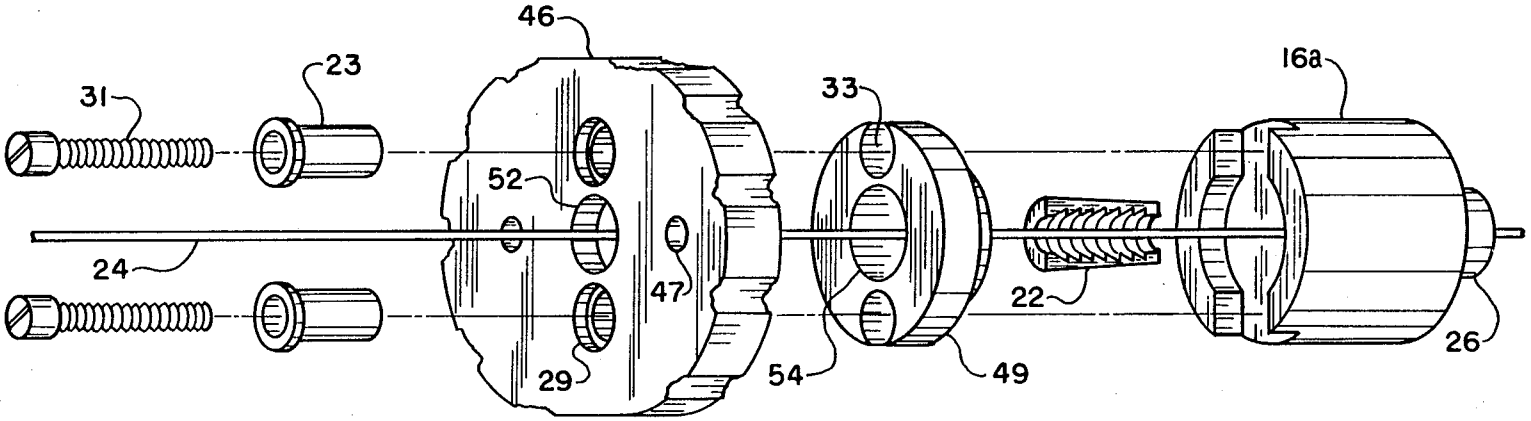
FIG. 13 is a exploded isometric view showing a prestressing strand installed in a master template/female coupler assembly.

FIG. 13 is an exploded isometric view showing a prestressing strand installed in a master template/female connector assembly. In the Figure, the alignment bolts 31 fit into alignment bushings 23, which in turn extend through bushing hole 29 in master template 46, thence through bushing holes 33 in male template plug 49. The male template plug provides a connection with female coupling connector 16*a*, the bushings 23 extending into the keyway slot, while the alignment bolts 31 fit into tapped holes in the bottom of the slot, not shown. The prestressing strand 24 extends through strand hole 52 in the master template 46, through strand hole 54 in the template plug, and finally through the hole in connector 16*a*, and through strand tube 26. The feather members 22 secure the strand 24 within the connector 16*a*. The Figure also shows knock out holes 47 in the master template. When it is desired to remove one of the master template plugs, a punch or similar type tool is inserted through the knock out holes and struck to dislodge the plug from the template.

Figure 14:
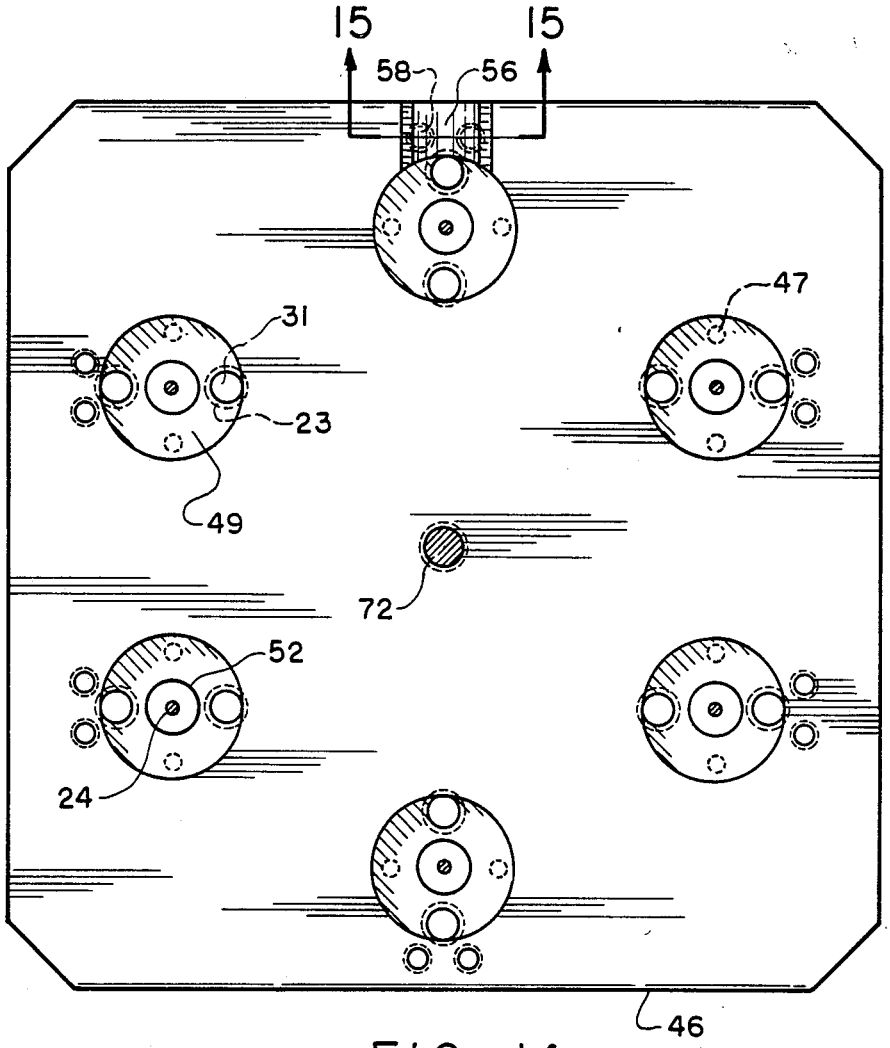
FIG. 14 is a plan view of a master template without couplers attached, as viewed from the side of the template in contact with concrete.

FIG. 14 is a plan view of master template, without coupling connectors attached, viewed from the side of the template in contact with the concrete. As shown, a number of template plugs 49 are located in countersunk holes in the plate. The number and location will depend upon the number and location of the prestressing strands required for the concrete structural members. Holes not needed are plugged, as previously explained. In the Figure, a prestressing strand 24 is shown extending through the strand holes 52, and alignment bolts 31 are illustrated in the center of the alignment bushings 23. Knock out holes 47 are also shown. The master template 46 is connected to the collapsible bulkhead by means of a connector bolt 72, as better illustrated in FIG. 16. A keyway plug 56 is located adjacent to the edges of the template, and secured to the latter by means of keyway bolts 58. In assembling the master templates, male or female template plugs, as the case may be, are inserted into countersunk holes located on one side of the master template. Thereafter, corresponding male or female coupling connectors are placed over the plugs and the alignment bushings are inserted through the template, the plugs, and into the keyways of the coupling connectors, and the components are secured by alignment bolts passed through the bushings and connected into the coupling connectors. Keyway plugs are thereafter located adjacent to the coupling connectors and attached to the master template by means of the keyway bolts.

The dimensions of the master template will depend upon the nature of the concrete structural members being formed; however, typically, in the case of concrete piles, the master template will be from about 12 to 30 inches, and about ¼ inch thick.

Figure 15:
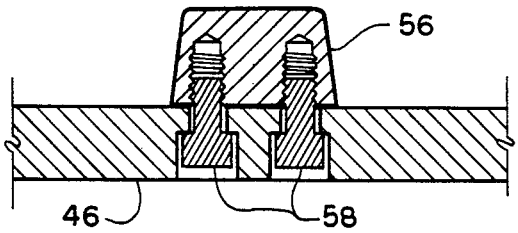
FIG. 15 is a partial cross-section taken along line 15—15 of FIG. 14.

FIG. 15 is a partial cross-section taken along line 15—15 of the FIG. 14. The Figure, shows additional detail of the keyway plug 56 attached to the master template by bolts 58. The dimensions of the plug will depend upon the dimensions of the coupling connectors, and keyway plugs having tapered sides as illustrated facilitate removal of the template from the concrete after formation of the structural member, and also allow easy insertion of the locking keys.

Figure 16:
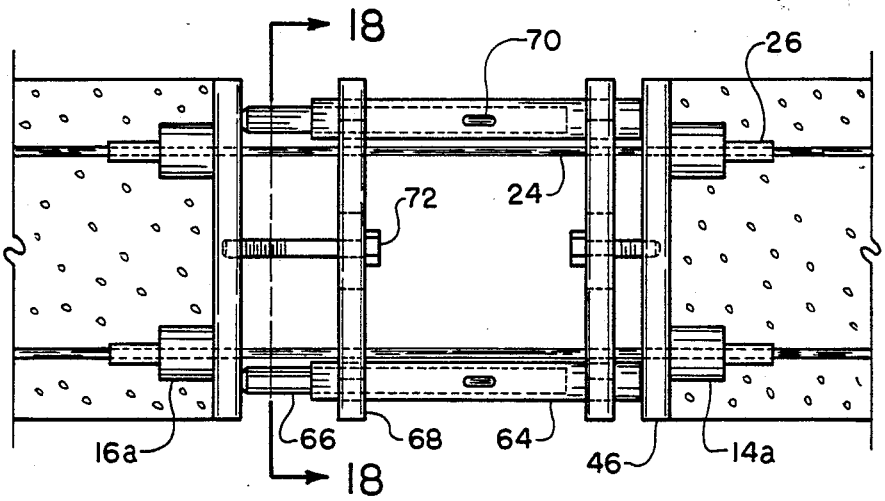
FIG. 16 is a side elevation of a collapsible bulkhead assembly.

FIG. 16 is a side elevation of a collapsible bulkhead assembly. A plurality of hollow sleeves 64, usually four in number, are inserted in tube plates 68, better seen in FIG. 18. Telescoping pins 66 are located in each of the sleeves, being held in an extended position by hitch pins 70 extending through the sleeves and pins, at right angles thereto. The tube plates are fastened to the master templates by means of connector bolts 72. Following assembly of the collapsible bulkhead to the master templates fixed to the structural members 12 as shown, the prestressing strands are place under tension. At that point, the concrete ends of the strand tubes are plugged to prevent the entry of concrete into the tubes during the pouring process, and a sealing mastic may be introduced into the coupling connectors, for example, 16*a*. The concrete is then poured and cured, and the feathers are thereafter inserted, as previously described.

Figure 17:
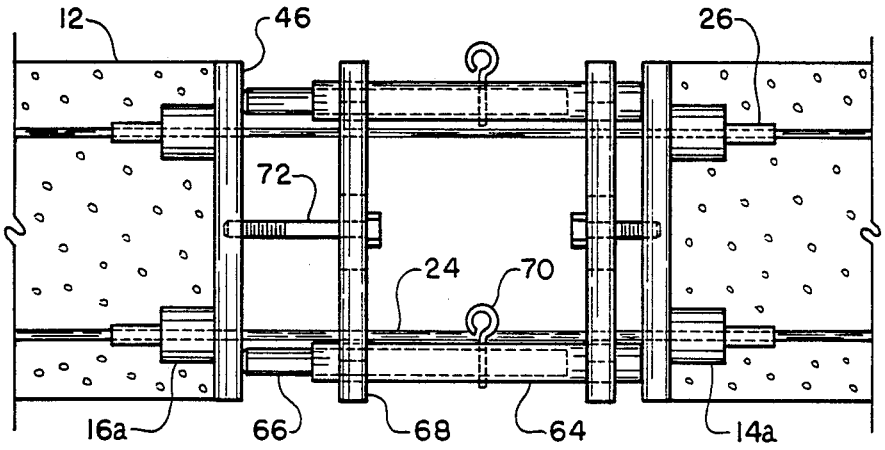
FIG. 17 is a top plan view of the bulkhead assembly of FIG. 16.

FIG. 17 is a top elevation of the bulkhead assembly of the FIG. 16. The nature of box-like structure is made clear in the Figure, the tube plates 68 holding sleeves 64 firmly in position at the corners thereof, and the hitch pins 70 locking the pins 66 in an extended position. Connector bolts 72 fasten the collapsible bulkhead to the master templates 46 connected, for example, to coupling connectors 16*a*. The strand tubes, located within the structural members 12, sealed as described, serve to continuously apply tension on the connectors.

To make the process of fabrication more economical, it is desirable to form more than one concrete structural member simultaneously in a casting bed. In such instances, however, if the tension is not released prior to severing the prestressing strands connecting adjacent structural members, the feather members used to secure the strands within the coupling connectors have a tendency to become dislodged from the connectors, making them ineffective. The collapsible bulkhead avoids this by allowing the tension in the strands to be released prior to their severing. As described, this can be done by removing the hitch pins 70 from the sleeves 64 prior to releasing the tension in the casting bed. When the tension is thereafter released, the strands within the collapsible bulkhead shrink, accommodated by the telescoping of the pins 66 within the sleeves. With the tension thus removed, the strands may be severed without affecting the feathers. Even in instances where the hitch pins are not released, the release of bed tension results in shearing of the pins, allowing the pins to retract within the sleeves, releasing the tension.

Figure 18:
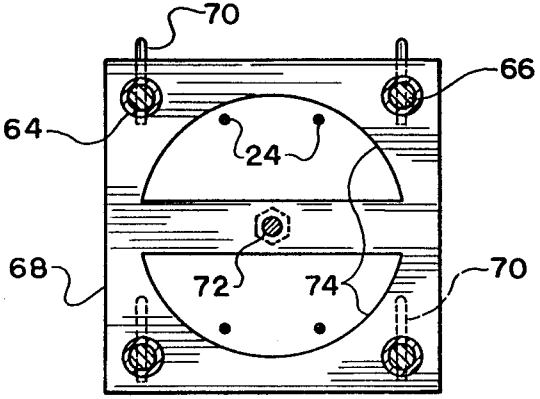
FIG. 18 is cross-section of the bulkhead assembly of FIG. 16, along line 18—18 of that figure.

FIG. 18 is a cross-section of the bulkhead assembly of FIG. 16, along line 18—18 of that Figure. The Figure shows details of the tube plate 68, i.e., a flange perforated for passage of the prestressing strands therethrough, including features such as the sleeves 64, with the pins 66 located therein. Also shown are the hitch pins 70 and the location of the connector bolt 72.

While in accordance with the patent statutes, a preferred embodiment and best mode has been presented, the scope of the invention is not limited thereto, but rather is measured by the scope of the attached claims.

What is claimed is:

1. A concrete structural member splicing device comprising:

a male connector;

a female connector;

a locking key member; and locking means, said male connector comprising a first elongated block, a first end of which is shaped, said block having an axial first hole passing therethrough, a portion of said first hole defining the shape of a frustum whose larger end lies toward said first end of said first block, while another portion of said first hole adjacent the larger end of the frustum-shaped portion, defines a first shaped chamber whose end lying opposite said frustum-shaped portion is provided with opposed ledge members transversely positioned relative to the longitudinal axis of said first hole;

said female connector comprising a second block with an axial second hole passing therethrough, a second shaped end of said second hole having dimensions adapted to receive the first end of said first block, while the portion of said second hole adjacent said second end defines a second shaped chamber whose end lying adjacent said second end is provided with opposed ledge members transversely positioned relative to the longitudinal axis of said second hole, while the other end of said second shaped chamber adjoins a portion of said second hole defining the shape of a frustum whose smaller end lies opposite said second end;

each of said first and second blocks being provided with a keyway extending through opposite walls thereof, one end of said keyway being defined by the spacing between said opposed ledge members, while the other end of said keyway is defined by the cross-sectional shape of the shaped chamber adjacent said ledge members;

said locking key member comprising an elongate member that includes transverse end portions that are wider than a center portion connecting said end portions, said center portion being adapted to be inserted between said opposed ledge members of said male and female connectors, and said end portions being adapted to be inserted into the portion of said first and second shaped chambers adjacent said ledge members when the ledge members of said male and female connectors are positioned adjacent each other so that said first and second holes are co-axial, and said locking means to grip prestressing elements of a concrete structural member so as to fasten said elements to said connectors.

2. A device according to claim 1 wherein said shaped ends and said shaped chambers have a circular transverse cross-section.

3. A splicing device according to claim 1 wherein said locking means comprises a plurality of associated feather members, said feather members comprising longitudinal segments of a member having a hollow frustum shape dimensioned to be received interior of the frustum-shaped portion of said axial holes, and to fit about the prestressing elements of a concrete structural member so as to fasten said elements to said connectors.

4. A splicing device according to claim 3 wherein said elongated blocks have a circular transverse cross-section.

5. A splicing device according to claim 1 in which said key member has a transverse cross-sectional shape approximating that of a member selected from the group consisting of key members having substantially a dumbbell shape, an I-beam shape, and an hourglass shape.

6. A concrete structural member having longitudinal prestressing elements located therein, one end of each of said elements being connected to a male connector as defined in claim 1 that is positioned on one end of said member, and the other end of each of said elements being connected to a female connector as defined in said claim that is positioned on the other end of said member.

7. A concrete structural member according to claim 6 in which said member is selected from the group consisting of a prestressed concrete pile, a prestressed concrete column, and a prestressed concrete girder.

8. A concrete structural member according to claim 6 in which the prestressing element is a multi-filament strand.

9. A concrete structural member according to claim 6 in which said connectors are fastened to steel plates, at right angles thereto, one such plate being positioned at each end of said member.

10. A tool for trimming prestressing elements used in connection with the splicing device of claim 1 including:

a body portion;

an extraction lug; and a cutting edge, said body portion comprising an elongate member having said cutting edge located on one end thereof, and said extraction lug extending at substantially right angles from said body portion, said body portion having a transverse cross-section adapted to pass through the keyways provided in said device, and said cutting edge being positioned on said end so as to contact said prestressing elements at the level of the bottom of said keyways when said body portion is driven through the keyways.

11. A master template for fabricating prestressed concrete structural members in a casting bed comprising:

a plate member, and a plurality of plate insert plugs, wherein said plate member contains a plurality of first strand holes therein adapted to receive prestressing strands passing therethrough, and also contains the same said plurality of countersunk areas on one side thereof, coaxial with said strand holes and capable of receiving said insert plugs therein, said plate member also having first alignment holes extending therethrough, said first alignment holes being adapted to receive alignment bushings therein, said first alignment holes being positioned over said countersunk areas, and wherein said insert plugs are dimensioned to be received into said countersunk areas, and when so received, second alignment holes in said insert plugs are positioned opposite and coaxial with said first alignment holes, said second alignment holes also being adopted to receive said bushings, and said plugs also being provided with second strand holes passing therethrough coaxial with said first strand holes, and wherein further, following their insertion into said plate member, the exposed surface of said insert plugs being adapted to mate with a said shaped end of a connector of the splicing device according to claim 1; and wherein still further, when so mated, said bushing holes are positioned so that inserted bushings are located within a keyway extending through said connector, so that said plate member, insert plug, and connector can be fastened together with bolts passing through said bushings into tapped holes located coaxially with said bushings in the bottom of said keyway.

12. A master template according to claim 11 wherein said plate member also has knock out holes extending through said plate member, positioned over said countersunk areas.

13. A concrete structural member splicing device comprising:

a male connector;

a female connector;

a locking key member; and locking means, said male connector comprising a first elongated block, a first end of which is shaped, said block having an axial first hole passing therethrough, a portion of said first hole defining the shape of a frustum whose larger end lies toward the first end of said first block, while another portion of said first hole adjacent the larger end of the frustum-shaped portion, defines a first shaped chamber whose end lying opposite said frustum-shaped portion is provided with opposed ledge members transversely positioned relative to the longitudinal axis of said first hole;

said female connector comprising a second block with an axial second hole passing therethrough, a second shaped end of said second hole having dimensions adapted to receive the first end of said first block, while the portion of said second hole adjacent said second end defines a second shaped chamber whose end lying adjacent said second end is provided with opposed ledge members transversely positioned relative to the longitudinal axis of said second hole, while the other end of said second shaped chamber adjoins a portion of said second hole defining the shape of a frustum whose smaller end lies opposite said second end;

each of said first and second blocks being provided with a keyway extending through opposite walls thereof, one end of said keyway being defined by the spacing between said opposed ledge members, while the other end of said keyway is defined by the cross-sectional shape of the shaped chamber adjacent said ledge members;

said locking key member comprising an elongate member that includes transverse end portions that are wider than a center portion connecting said end portions, said center portion being adapted to be inserted between said opposed ledge members of said male and female connectors, and said end portions being adapted to be inserted into the portion of said first and second shaped chambers adjacent said ledge members when the ledge members of said male and female connectors are positioned adjacent each other so that said first and second holes are co-axial;

said locking means being adapted to grip prestressing elements of a concrete structural member so as to fasten said elements to said connectors, and further comprising a hollow tube member axially aligned with each of said axial holes, said tube members being positioned in contact with the end of said connectors, opposite to the end of said axial holes adjacent to said ledge members, and said tube members being adapted to receive one of said prestressing elements.

14. A concrete structural member splicing device comprising:

a male connector;

a female connector;

a locking key member; and locking means, said male connector comprising a first elongated block, a first end of which is shaped, said block having an axial first hole passing therethrough, a portion of said first hole defining the shape of a frustum whose larger end lies toward the first end of said first block, while another portion of said first hole adjacent the larger end of the frustum-shaped portion, defines a first shaped chamber whose end lying opposite said frustum-shaped portion is provided with opposed ledge members transversely positioned relative to the longitudinal axis of said first hole;

said female connector comprising a second block with an axial second hole passing therethrough, a second shaped end of said second hole having dimensions adapted to receive the first end of said first block, while the portion of said second hole adjacent said second end defines a second shaped chamber whose end lying adjacent said second end is provided with opposed ledge members transversely positioned relative to the longitudinal axis of said second hole, while the other end of said second shaped chamber adjoins a portion of said second hole defining the shape of a frustum whose smaller end lies opposite said second end;

each of said first and second blocks being provided with a keyway extending through opposite walls thereof, one end of said keyway being defined by the spacing between said opposed ledge members, while the other end of said keyway is defined by the cross-sectional shape of the shaped chamber adjacent said ledge members;

said locking key member comprising an elongate member that includes transverse end portions that are wider than a center portion connecting said end portions, said center portion being adapted to be inserted between said opposed ledge members of said male and female connectors, and said end portions being adapted to be inserted into the portion of said first and second shaped chambers adjacent said ledge members when the ledge members of said male and female connectors are positioned adjacent each other so that said first and second holes are co-axial;

said locking means being adapted to grip prestressing elements of a concrete structural member so as to fasten said elements to said connectors, and wherein each of said connectors is provided with a plurality of alignment bolt holes extending downward at right angles from the end of said connectors adjacent their mating surfaces.

15. A concrete structural member having longitudinal prestressing elements located therein, one end of each of said elements being connected to a male connector comprising a first elongated block, a first end of which is shaped, said block having an axial first hole passing therethrough, a portion of said first hole defining the shape of a frustum whose larger end lies toward said first end of said first block, while another portion of said first hole adjacent the larger end of the frustum-shaped portion defines a first shaped chamber whose end lying opposite said frustum-shaped portion is provided with opposed ledge members transversely positioned relative to the longitudinal axis of said first hole, that is positioned on one end of said member, and the other end of each of said elements being connected to a female connector comprising a second block with an axial second hole passing therethrough, a second shaped end of said second hole having dimensions adapted to receive the first end of said first block, while the portion of said second hole adjacent said second end defines a second shaped chamber whose end lying adjacent said second end is provided with opposed ledge members transversely positioned relative to the longitudinal axis of said second hole, while the other end of said second shaped chamber adjoins a portion of said second hole defining the shape of a frustum whose smaller end lies opposite said second end, that is positioned on the other end of said member wherein each of said connectors is provided with a hollow tube positioned within said member, in contact with the end of said connector, and in axial alignment with the axial hole extending therethrough, said tube being adapted to received a part of the prestressing element connected to each of said connectors, thereby forming a relaxation cavity in which said part is protected from contact with concrete, allowing said part to place continuous tension on said connector.

16. The process of simultaneously forming multiple prestressed concrete members in a casting bed, comprising:

fastening connectors for a structural member splicing device to a master template;

said structural member splicing device comprising:

a male connector;

a female connector;

a locking key member; and locking means, said male connector comprising a first elongated block, a first end of which is shaped, said block having an axial first hole passing therethrough, a portion of said first hole defining the shape of a frustrum whose larger end lies toward said first end of said first block, while another portion of said first hole adjacent the larger end of the frustrum-shaped portion, defines a first shaped chamber whose end lying opposite said frustrum-shaped portion is provided with opposed ledge members transversely positioned relative to the longitudinal axis of said first hole;

said female connector comprising a second block with an axial second hole passing therethrough, a second shaped end of said second hole having dimensions adapted to receive the first end of said first block, while the portion of said second hole adjacent said second end defines a second shaped chamber whose end lying adjacent said second end is provided with opposed ledge members transversely positioned relative to the longitudinal axis of said second hole, while the other end of said second shaped chamber adjoins a portion of said second hole defining the shape of a frustrum whose smaller end lies opposite said second end;

each of said first and second blocks being provided with a keyway extending through opposite walls thereof, one end of said keyway being defined by the spacing between said opposed ledge members, while the other end of said keyway is defined by the cross-sectional shape of the shaped chamber adjacent said ledge members;

said locking key member comprising an elongate member that includes transverse end portions that are wider than a center portion connecting said end portions, said center portion being adapted to be inserted between said opposed ledge members of said male and female connectors, and said end portions being adapted to be inserted into the portion of said first and second shaped chambers adjacent said ledge members when the ledge members of said male and female connectors are positioned adjacent each other so that said first and second holes are co-axial, and said locking means being adapted to grip prestressing elements of a concrete structural member so as to fasten said elements to said connectors;

said master template comprising a plate member, and a plurality of plate insert plugs, wherein said plate member contains a plurality of first strand holes therein adapted to receive prestressing strands passing therethrough, and also contains the same said plurality of countersunk areas on one side thereof, coaxial with said strand holes and capable of receiving said insert plugs therein, said plate member also having first alignment holes extending therethrough, said first alignment holes being adapted to receive alignment bushings therein, said first alignment holes being positioned over said countersunk areas, and wherein said insert plugs are dimensioned to be received into said countersunk areas, and when so received, second alignment holes in said insert plugs are positioned opposite and coaxial with said first alignment holes, said second alignment holes also being adapted to receive said bushings and said plugs also being provided with second strand holes passing therethrough coaxial with said first strand holes, and wherein further, following their insertion into said plate member, the exposed surface of said insert plugs being adapted to mate with a said shaped end of a connector of the splicing device; and wherein still further, when so mated, said bushing holes are positioned so that inserted bushings are located within a keyway extending through said connector, so that said plate member, insert plug, and connector can be fastened together with bolts passing through said bushings into tapped holes located coaxially with said bushings in the bottom of said keyway;

fastening one of said master templates on each side of a collapsible bulkhead to form assemblies;

threading prestressing strands through said assemblies and through hollow tube members adjacent said connectors;

fastening one end of said strands to a stationary casting bed bulkhead, and the other end of said strands to a casting bed jack;

placing said strands under tension;

pouring and curing the concrete;

installing said feather member;

removing said pins;

releasing said tension; and thereafter severing said prestressing strands at a point within said collapsible bulkhead.

* * * * *